US006216903B1

(12) United States Patent
Hirose et al.

(10) Patent No.: US 6,216,903 B1
(45) Date of Patent: Apr. 17, 2001

(54) BI-DIRECTIONAL OPERATING CLOSURE FOR A LIQUID CONTAINER

(75) Inventors: Masato Hirose; Yasuhiro Kowa; Toru Goto, all of Toyko (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 09/274,198

(22) Filed: Mar. 22, 1999

(30) Foreign Application Priority Data

Mar. 19, 1998 (JP) ..... 10-082242

(51) Int. Cl.[7] ..... B65D 51/18; A47G 19/22

(52) U.S. Cl. ..... 220/253; 220/710.5; 220/713; 220/715; 220/254; 222/484; 222/469; 222/481.5

(58) Field of Search ..... 220/256, 253, 220/255, 254, 713, 711, 710.5, 367.1, 714, 715, 719; 222/484, 469, 153.01, 470, 481.5, 482

(56) References Cited

U.S. PATENT DOCUMENTS

| | | | | |
|---|---|---|---|---|
| 1,449,811 | * | 3/1923 | Dacey | 222/484 |
| 1,564,336 | * | 12/1925 | Fischbach | 220/254 X |
| 1,778,424 | * | 10/1930 | Long | 222/469 X |
| 2,362,387 | * | 11/1944 | Ludwig | 222/569 |
| 2,416,900 | * | 3/1947 | Busby | 220/254 X |
| 3,140,799 | * | 7/1964 | Mehr | 222/484 X |
| 4,057,177 | * | 11/1977 | Laauwe | 222/481.5 X |
| 4,712,704 | * | 12/1987 | Ramsey et al. | 220/254 |
| 5,036,993 | * | 8/1991 | Ramsey | 220/713 X |
| 5,169,016 | * | 12/1992 | Hinz, Jr. | 220/254 |
| 5,186,353 | * | 2/1993 | Ramsey | 220/713 X |
| 5,269,432 | * | 12/1993 | Bechertgis | 220/256 X |
| 5,273,194 | * | 12/1993 | McNamara | 222/470 |
| 5,294,014 | * | 3/1994 | Wyatt et al. | 222/484 X |
| 5,370,260 | * | 12/1994 | Paramski . | |
| 5,449,085 | * | 9/1995 | Brun, Jr. | 220/256 X |
| 5,540,350 | * | 7/1996 | Lansky | 220/719 X |
| 5,680,951 | * | 10/1997 | Feltman, III et al. | 220/710.5 X |
| 5,918,761 | | 7/1999 | Wissinger | 220/713 |

FOREIGN PATENT DOCUMENTS

| | | | | |
|---|---|---|---|---|
| 223840 | * | 3/1958 | (AU) | 220/367.1 |
| 248645 | * | 12/1963 | (AU) | 220/253 |
| 290418 | * | 11/1988 | (EP) | 220/253 |

* cited by examiner

*Primary Examiner*—Allan N. Shoap
*Assistant Examiner*—Robin A. Hylton
(74) *Attorney, Agent, or Firm*—Darby & Darby

(57) ABSTRACT

A bi-directional closure to dispense liquid through the open mouth of a container having a projecting handle. The closure includes a closing member fitting into the container open mouth to seal the mouth and the closing member has a pair of spaced outlet ports. A lid is rotatably mounted relative to the closing member and has a pair of spaced liquid pouring openings and a pair of spaced air holes and an operating lever is mounted on one of the closing member and lid and projects therefrom for rotating one relative to the other. When the lid is in a home position relative to the closing member with the operating lever aligned with the container handle the pair of outlet ports of the closing member are sealed. Rotation of the lid relative to the closing member in one direction from the home position by a predetermined amount to a first position by moving the operating lever aligns a respective one of the lid pouring openings with a closing member outlet port and one of the lid air holes with the other of the closing member outlet ports. Rotation of the lid relative to the closing member in a second direction opposite to the first direction by a predetermined amount to a second position by operating the lever aligns the other of the lid pouring openings with the other outlet port of the closing member and the lid one other air hole with the closing member one outlet port. The arrangement permits use by a person who uses either the right or left hand.

6 Claims, 2 Drawing Sheets

BI-DIRECTIONAL OPERATING CLOSURE FOR A LIQUID CONTAINER

BACKGROUND OF THE INVENTION

1. Field of the Invention

The present invention relates to the structure of an opening for pouring on a container storing a liquid, such as a cup, water bottle, thermos bottle, etc., and in particular relates to a structure of the opening on a container for liquids which, when pouring out the liquid stored in the container, does not pour out a large amount at one time from the container opening, but pours out only an appropriate amount; prevents overflowing; and when necessary, provides the amount appropriate for drinking directly from the container.

This application is based on Japanese Patent Application, No. Hei 10-82242, the contents of which are incorporated herein by reference.

2. Description of the Related Art

Containers like bottles for storing seasonings such as soy sauce, water bottles and thermos bottles for storing, preserving, and carrying drinks such as hot water and coffee, and heat retaining cups, etc., which have a heat retaining capacity, are used as containers for storing and preserving liquids. In addition, among these containers, particularly in containers which store liquids such as soy sauce, etc., there are those which provide an extraction cap having an aperture bored into it for appropriately adjusting the amount of the portion at the opening in such a manner that a large amount of any type of liquid will not pour out in one portion from the opening when the stored liquid is poured out during use.

In addition, in a portable liquid container such as water bottle or a thermos bottle, like that disclosed in Japanese Patent Application, First Publication, No. Hei 7-251854, containers for drinks have been proposed and marketed which do not pour out a large amount, but rather appropriately restrict the amount of flow, even when drinking, when bringing the opening as it is to the mouth while consuming the beverage. That is, this container for drinks is a cup shaped insulating heat retaining container having a wide opening and a lid with a slanted bottom surface, and an engaged lid member provided with a liquid passage hole on the slanted bottom surface and an air hole on the slanted top. At the same time, two screw threads for installation of the lid member are provided such that ends of the screw threads for installation on the container opening are off-set from each other by 90° with the handle positioned therebetween.

In addition, in this manner, by engaging this lid member on the opening of the container, when pouring, the amount of the liquid poured can be limited by the size of the liquid passage hole, and there is not spurting which can cause the drinker to choke and cough, or stopping up, and it is possible to consume an appropriate amount of beverage. In addition, the installation of the lid member can be carried out by appropriately selecting either one of the two screw threads to use, and thereby whether one is right or left handed, by grasping the handle according to one's handedness, the liquid flow passage hole can be positioned on the mouth, and thus can be used skillfully and suitably depending on one's handedness.

However, when used by itself, the above type of opening structure, which provides an aperture hole for adjusting the amount of the flow of the portion, is usually open, and thus there are the problems that contaminants can enter the container, and when accidentally overturned, the contents will spill from the container. Because of this, in a bottle container for seasonings such as soy sauce, etc., it is a fact that the lid cap must always be installed on the opening.

In addition, in insulated liquid containers with a wide opening such as thermos bottles or insulated cups, etc., the heat inside the container escapes outside through the open liquid passage hole and the air hole, causing the heat and cold retaining effect to deteriorate, and thus their characteristic capacities as insulating containers cannot be used to sufficient advantage.

SUMMARY OF THE INVENTION

In consideration of the above problems, it is the goal of the present invention to provide a structure for an opening for a container for liquids which overcomes the above-described inconveniences; can restrict the amount of liquid while pouring; can have the pouring position appropriately positioned depending on handedness when grasped by a person of either handedness; and in addition, when not in use cut off the interior of the container from outside air, preventing contaminants from entering and spillage when turned over; and at the same time in an insulated container can maintain heat retention; and is convenient to use.

In order to overcome the above problems, the present invention is characterized in providing an opening member disposed airtight and detachably on the opening of the container, this opening member rotatably housing a rotating lid member which has a lid body that slides on the bottom surface of a container-shaped pouring member provided with two fixed pouring openings on the bottom surface, and at the same time, on the lid body of this rotating lid member are provided pouring openings and air holes which respectively engage simultaneously with two fixed pouring openings on the bottom surface of this pouring member by the rotation of this rotating lid member.

In this structure of an opening for a container for liquids of the present invention, the two fixed pouring openings provided on the bottom surface of this pouring member can be disposed on opposite sides of a center, and the pouring opening and the air hole on the lid body of the rotating lid member, which slides by rotation on the bottom surface of the pouring member, can be disposed at positions corresponding to the two fixed pouring openings on the bottom surface of this pouring member.

In addition, in this structure of an opening for a container for liquids of the present invention, the pouring openings and air holes of the lid body of the rotating lid member engage with the two fixed pouring opening on the bottom surface of the pouring member, and constitute two paired groups disposed at adjacent positions such that the pouring openings are less than 180° apart.

Additionally, in the structure of an opening for a container for liquids of the present invention, an engagement-release member can be provided on the respective sliding surfaces of the bottom surface of the pouring member and the lid body of the rotating lid member for positioning the opening and closing positions when the fixed pouring opening of the pouring member and the pouring opening of the rotating lid member are engaged and when the fixed pouring opening is closed.

Furthermore, in the structure of an opening for a container for liquids of the prevent invention, this engaging release part can be a concave (or concave) parts.

In addition, in the structure of an opening for a container for liquids of the present invention, at least one of the concave (or convex) parts can be an elastic material.

Additionally, in the structure of an opening for a container for liquids of the present invention, the bottom surface of the pouring member and the sliding surface of the lid body of the rotating lid member which slides thereon can have an umbrella shape which rises gradually towards the center.

Furthermore, in the structure of an opening for a container for liquids of the prevent invention, the disposition of the rotating lid member which can rotate by sliding on the bottom surface of the pouring member is connected by an pivot via an urging member.

The structure of the opening for a container for liquids of the present invention produces effects such as those disclosed below when implemented in the above-described manner:

Because the opening of container for liquids is made so that a pouring opening which restricts the amount of flow is formed, it is possible to pour out an appropriate amount which does not produce overflow by pouring out at one time the liquid stored in the container; and thereby it is possible to manage the pouring safely.

In addition, as a container for beverages, of course it is possible to carry it while a liquid is stored therein, and even when drinking directly from the opening part as-is, because the pouring of the liquid is restricted to an appropriate amount, not only is there no spilling, there is no spurting which can cause the drinker to choke and cough, or stopping up, and the liquid can be safely consumed. In particular, it is very convenient for retaining the heat of a hot beverage while it is being carried, and is very convenient for drinking directly therefrom.

Furthermore, because two fixed pouring openings are provided disposed in a positional relationship of 180°, and one of the fixed pouring openings can be selected for opening by rotating the rotating lid member appropriately according to need, no matter whether the person is right or left handed, if either of the fixed openings is open by either hand, the container can be grasped according to handedness, making for a convenient pouring direction, and the liquid poured skillfully.

In addition, when not in use, because the fixed pouring opening is closed by the rotating lid member, contamination can be prevented, and in a heat retaining container, the dissipation of the heat of the stored liquid can be prevented, producing the effect of maintaining the heat or cold of the liquid.

Additionally, because the opening member is detachably installed on the container opening, not only can the cleaning of the container and the a closing member of an opening be appropriately carried out, but because the opening member can also be disassembled, it is possible to clean even the corners, and is thus extremely hygienic.

DESCRIPTION OF THE PREFERRED EMBODIMENTS

Figure 1:
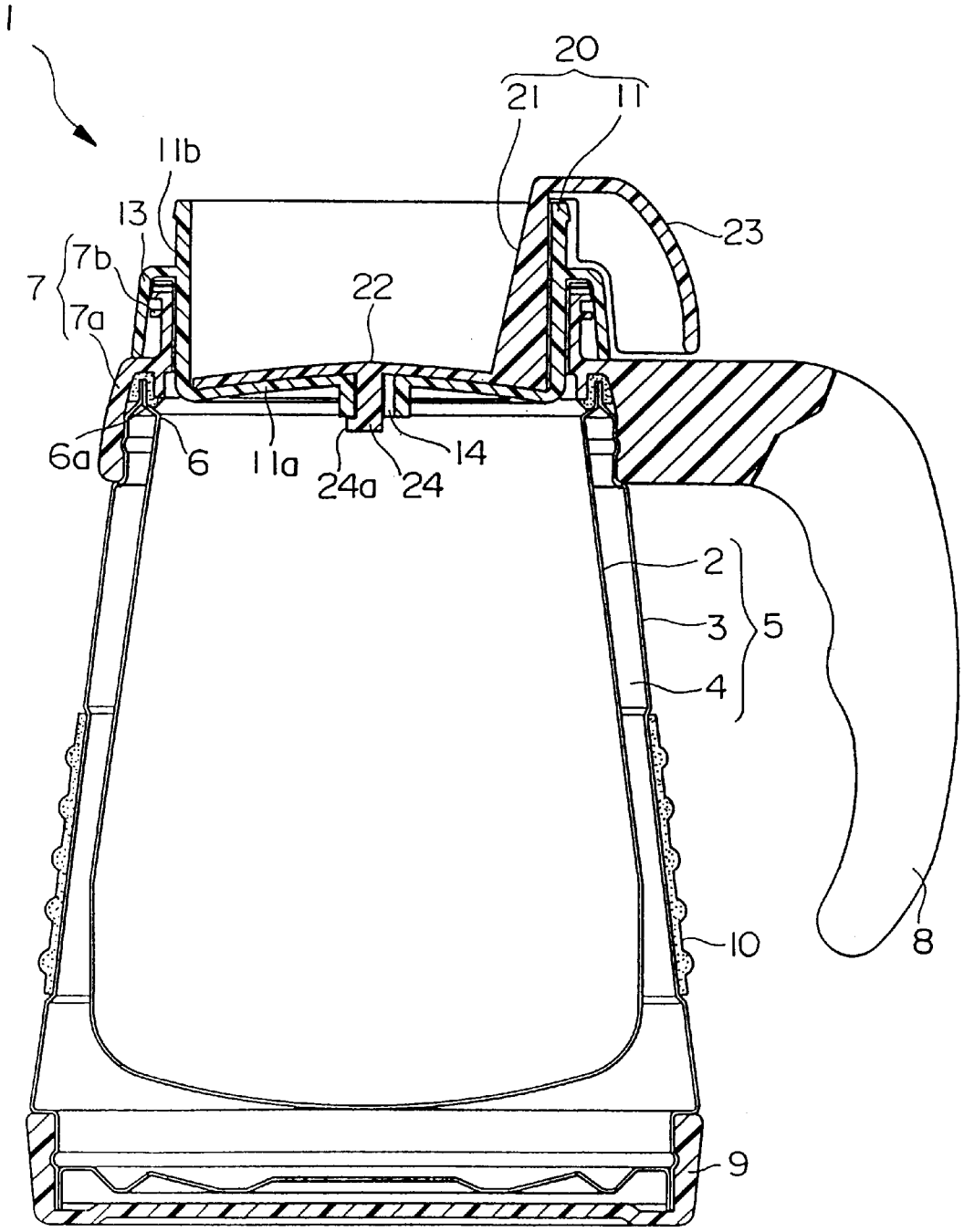
FIG. 1 is a vertical cross-section of a heat retaining cup showing an example of the container for liquids in order to explain the structure of the opening of the container for liquids of the present invention.

In the present invention, in order to pour out an appropriate amount of liquid, on the bottom surface in the opening of a container for liquids, an a closing member of an opening, wherein a rotating lid member having a lid body which rotates by sliding on the bottom surface of a container-shaped pouring member provided with fixed pouring openings in two places, is installed airtight and detachably, and at the same time this lid body is provided with a pouring opening and an air hole which respectively simultaneously engage the two fixed pouring openings on the bottom surface of this pouring member by the rotating of the rotating lid member.

In addition, by rotating the rotating lid member when pouring a liquid and aligning the positions of the pouring opening and the air hole provided on the lid body of this rotating lid member with the two fixed pouring openings provided on the bottom surface of the pouring member, a liquid in the container can be poured out in an appropriate amount through the pouring opening. In addition, when pouring is unnecessary, the rotating lid member is rotated so that the pouring opening and the air hole of the lid body of the rotating lid member are not aligned with the two fixed pouring openings on the bottom surface of the pouring member, and the two fixed pouring openings on the bottom surface of the pouring member are closed off by the lid body of the rotating lid member.

The two fixed pouring openings provided on the bottom surface of this pouring member are disposed on opposite sides of a center, and the pouring openings and air holes of the lid body of the rotating lid member, which are aligned with these two fixed pouring openings due to rotating by sliding on the bottom surface of this pouring member, are disposed at positions (the pouring openings—air holes are in an opposing positional relationship) respectively corresponding to these two fixed pouring openings, and thereby when the pouring opening of the lid body of the rotating lid member is aligned with one of the fixed pouring openings of the pouring member, the air hole of the lid body of the rotating lid member is necessarily aligned with the other fixed pouring opening, and the pouring of the liquid in the container can be carried out easily.

In addition, the pouring opening and the air hole of the lid body of the rotating lid member which align with the two fixed pouring openings on the bottom surface of the pouring member are provided in two opposing sets. Additionally, by disposing the two pouring openings of this lid body adjacently at an angle of 180° or less, when one of the two pouring openings of the lid body of the rotating lid member is disposed over one of the two the fixed pouring openings on the bottom surface of the pouring member, the other pouring opening of the lid body of the rotating lid member is disposed on the bottom surface at a place not overlapping the other fixed pouring opening of the pouring member, and the other pouring opening of the lid body is closed. In addition, by rotating the other pouring opening of the lid body of this closed rotating lid member to the fixed pouring opening of the pouring member which is positioned near it, the other pouring opening of the lid body can be aligned with the other fixed pouring opening of the pouring member. In this manner, by appropriately selecting the two differently positioned fixed pouring openings of the pouring member, the opening operation can be carried out.

In addition, on the respective sliding surfaces of the bottom surface of the pouring member and the lid body of the rotating lid member which can rotatably slide over the bottom surface of this pouring member; an engagement-release part is provided for regulating and positioning the rotation of the rotating lid member when the two fixed pouring openings on the bottom surface of the pouring member and the pouring opening of the lid body of the rotating lid member are in an aligned state and the fixed pouring opening is in a closed state, and the open and closed states of the fixed pouring opening can be stably maintained.

Additionally, a concave (or convex) parts can be formed and provided as the above engagement-release part, and by engaging this concavo-convexity, it is possible to reliably govern the rotation of the rotation lid member more simply. Furthermore, by holding at least one of the engaged concave (or convex) parts parts which engage as the engagement-release part by an elastic material, it is possible to lower the wear by moderating the friction during engagement and separation.

In addition, by making the bottom surface of the pouring member and the lid body of the rotating lid member which slides on it an umbrella shape defining a gradual slope by rising towards the center; even when these two are made to slide by forced urging, it is possible to apply a degree of strength with does not deform, and in addition, in this manner, it is possible to make these members thin.

By making the lid body of the rotating lid member disposed rotatably by sliding on the bottom surface of the pouring member communicate with the pouring member by an axle via an urging member, it is possible to carry out the rotation operation with a close integral engagement between the pouring member and rotating lid member, a reliable positioning of the rotation lid member, and a firm operational sense.

Below, an embodiment of the structure of the opening of the container for a liquid of the present invention will be explained using a heat retaining cup as an example of a container. FIG. 1 is a vertical cross-section of a heat retaining cup whose wall is a vacuum insulating wall. The heat retaining cup 1 comprises a double walled container 5 wherein an inner container 2 and an outer container 3 made of a metal such as stainless steel are integrally formed as so to enclose an insulating layer 4 comprising a vacuum space. Additionally, on the opening 6, an inverted U shaped interfitting part 7*a* provided on the lower part interfits so as to protect and cover the circumference 6*a* along its end circumference 6*a,* and a shoulder member 7 made, for example, of a synthetic resin which has a drink opening 7*b* on the upper part, is provided. Moreover, when a handle 8 is attached to this shoulder member 7, it is convenient to grasp the cup while drinking. Additionally, 9 is a bottom member made, for example, of synthetic resin, for suitably protecting the bottom as necessary, and 10 is a shell band which suitably covers the shell as necessary, for protecting the shell part and providing alterations and characteristics in design.

In the present invention, at the drinking opening 7*b* of the shoulder member 7 of the opening 6 of a container, such as the type of heat retaining cup 1 described above, an a closing member of an opening 20 providing a rotating lid member 21 having a lid body 22 disposed so as to rotatably slide on the bottom surface 11*a* is disposed airtight and detachably in the container shaped pouring member 11 providing on the bottom surface 11*a* of a fixed pouring opening 12 which regulates the amount of the portion that is poured. Moreover, the a closing member of an opening 20 can be directly mounted on the opening 6 of the heat retaining cup 1.

Figure 2:
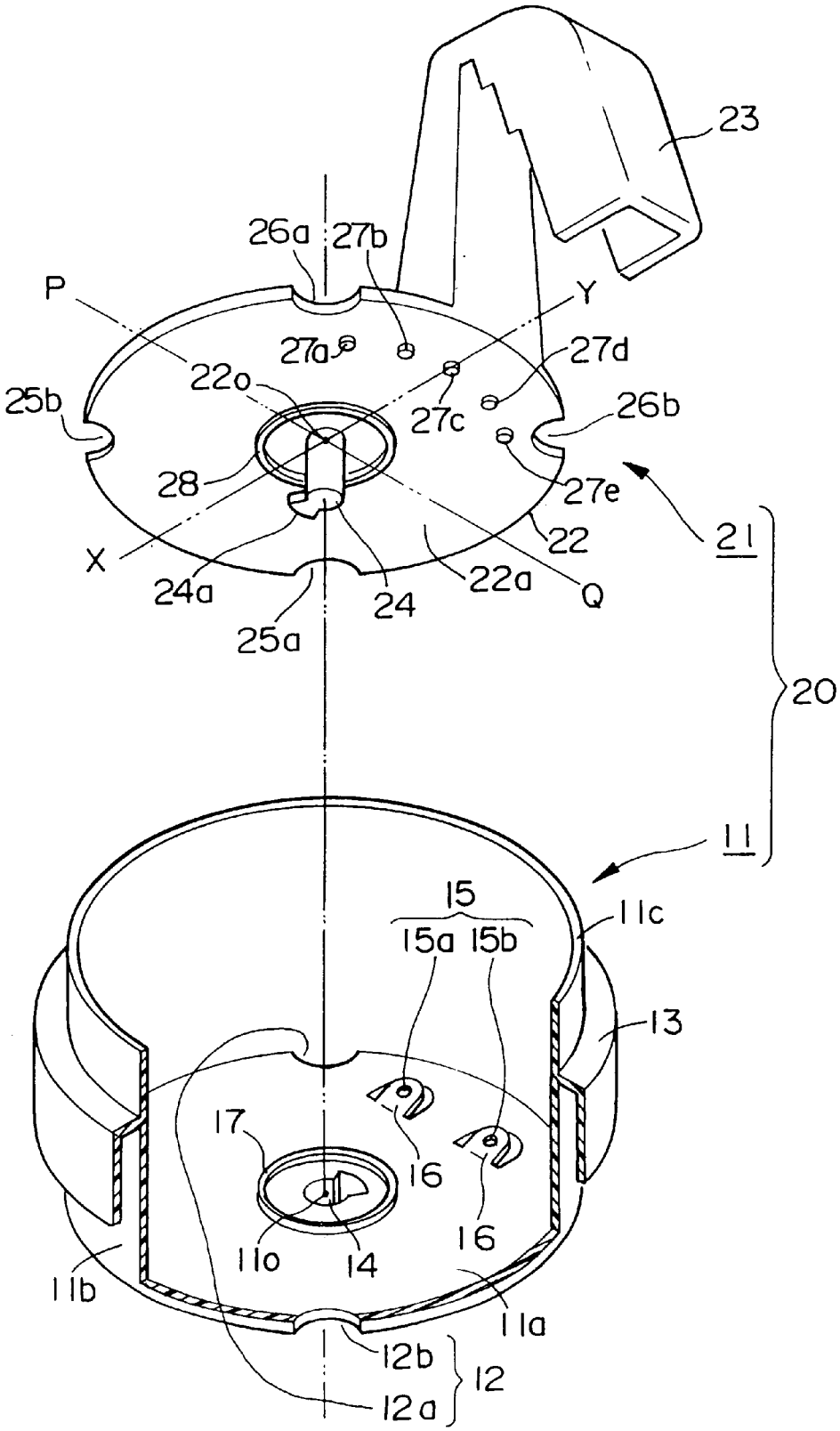
FIG. 2 is a figure for explaining the assembly of the a closing member of an opening detachably installed in the opening of the heat-retaining cup of FIG. 1.

FIG. 2 is a figure for explaining the assembly of the a closing member of an opening 20 detachably installed in the drinking opening 7*b* of the shoulder member 7 provided on the opening 6 of the heat-retaining cup of FIG. 1. As shown in FIG. 2, the a closing member of an opening 20 comprises a container shaped pouring member 11 having a bottom installed airtight on the drinking opening 7*b* of the shoulder member 7 provided on the opening 6 of the container, and a rotating lid member 21 having a lid body 22 inserted in the pouring member 11 and disposed to slide rotatably along the bottom surface 11*a* of this pouring member 11. Moreover, the pouring member 11 and the rotating lid member 21 are preferably formed from a synthetic resin material.

The pouring member 11 has the shape of a container with a bottom surface 11*a* having a shell 11*b* shaped to conform to the inner wall of the opening 6 of the heat retaining cup 1 or the drinking opening 7*b* of the shoulder member 7, and on this shell 11*b,* an interfitting installation shield 13 with an inverted L shaped cross-section is provided which opens towards the lower part for installing the pouring member 11 on the opening 6 of the heat retaining cup 1 or on the drinking opening 7*b* of the shoulder part along the outer perimeter of the lower part of the opening 11*c*. In addition, on the bottom surface 11*a,* two fixed pouring openings 12*a,* 12*b* are provided on their respective circumferential edge parts of the position (maintaining an angle of about 180°) on opposite sides of the center 11*o* of the bottom surface. Additionally, on the center part 11*o,* an axle support hole 14 in which the rotation axle 24 of the rotating lid member 21 described below pivots rotatably is provided. Moreover, the shape of the axle support hole 14 can be the shape of a two stage radial cross-section having a two stage radius like a mushroom for ease of detachment and reliability of engagement.

In addition, in the area of this axle support hole 14 of the bottom surface 11*a,* along the rotation path of the rotation axle of the rotating lid member 21 (described below) pivoting in the axle support hole 14, the engagement-release concave (or convex) parts 15*a,* 15*b* are disposed. The rotation of the rotation member 21 is regulated by these concave (or convex) parts 15*a,* 15*b,* when the fixed pouring opening 12 of the bottom surface 11*a* of the pouring member 11 is respectively in an opened and closed state due to the rotation of the rotating lid member 21. Additionally, these engagement-release concave (or convex) parts 15*a,* 15*b,* can reduce friction due to the contact of the convexity and concavity when they are engaged by providing, for example, an elastic member 16 which is cut in a tongue shape to impart elasticity. Moreover, reference numeral 17 is a convex sliding ring for augmenting rotation formed along the outer perimeter of the axle support hole 14.

In contrast, the rotating lid member 21 is disposed in the above-mentioned container shaped pouring member 11 with a bottom formed by a lid body 22 which slides on the bottom surface 11*a* of the pouring member 11, and is a plate shaped body having almost the same form as the form of the bottom surface 11*a* of the pouring member, and an operation lever member 23 which, when the lid body 22 is disposed by sliding over the bottom surface 11*a* of the pouring member 11, contacts the inner wall of the shell 11*b* of this pouring member 11, extends upward to the outside of the opening 11*b* of the pouring member 11, and the upper edge of which bends towards the outside. Additionally, on the lower sliding surface 22*a* of the lid body 22 which slides on the bottom surface 11*a* of the pouring member 11, at the center 22*o,* a rotating axle 24 which pivots rotatably in the axle support hole 14 is provided on this pouring member 11. Moreover, the rotation axle 24 conforms to the shape of the axle support hole 14, and its cross-section can have a two stage radius cross-section having a two-stage radius like a mushroom.

In addition, two pouring holes 25*a,* 25*b* are provided adjacently (at an angle of 180° or less), with their positions defined by a line P–Q inserted therebetween perpendicular to line X–Y joining the installation position of the above-mentioned operation lever member 23 and passing through the center 22*o,* and a line X–Y inserted therebetween on the surface of the lid body 22 on the opposite side of the installation position of the operation lever member 23, having the center point 22*a* as an axis, and joining the installation position of this operation lever member 23 and the center point 22*o,* making almost equal angles within 90° on both sides. In addition, the positions of these pouring openings 25*a,* 25*b* are provided at a position so as to engage the fixed pouring holes 12*a,* 12*b* provided on the bottom surface 11*a* of the pouring member 11 by the rotation of the lid body 22.

Moreover, at positions on the opposite sides of the center 22*o* of the pouring openings 25*a,* 25*b,* air holes 26*a,* 26*b* are provided, respectively.

In addition, at the lower sliding surface 22*a* of the lid body 22 of the rotating lid member 21, an engagement-release convex (or concave) parts 27 is provided which engages the two engagement-release concave (or convex) parts 15*a,* 15*b* provided on the bottom surface 11*a* of this pouring member 11 on the surface near the setting position of the operating lever member 23. Moreover, in the drawing shown in FIG. 2, the engagement-release convex (or concave) parts 27 has five members, 27*a,* 27*b,* 27*c,* 27*d,* and 27*e*. Additionally, in the respective states ① when the pouring opening 25*b* of the lid body 22 engages with the fixed pouring opening 12*b* of the bottom surface 11*a* of the pouring member 11 due to the leftward rotation of the rotating lid member, ② when the pouring opening 25*a* of the lid body 22 is engages with the fixed pouring opening 12*a* of the bottom surface 11*a* of the pouring member 11 due to the rightward rotation of the rotating lid member 21, or ③ when both of the two fixed pouring openings 12*a* and 12*b* of the bottom surface 11*a* of the pouring member 11 on the lid body 22 of the rotating lid member 21 are closed, the five engagement-release convex (or concave) parts 27*a,* 27*b,* 27*c,* 27*d,* and 27*e* provided on the lid body 22 of the rotating lid member 21 are disposed so that two among these five are positioned in these three positional states ①, ②, and ③ by engaging with the two engagement-release concave (or convex) parts 15*a,* 15*b* on the bottom surface 11*a* of the pouring member 11. Additionally, reference numeral 28 is, for example, a convex sliding ring projection for rotational augmentation formed along the outer perimeter of the rotational axle 24.

Moreover, the disposing of the two pouring openings 25*a* and 25*b,* disposed on the lower sliding surface 22*a* of the lid body 22 of the above-described rotating lid member 21 and the disposition of the five engagement-release convex (or concave) parts 27*a,* 27*b,* 27*c,* 27*d,* and 27*e,* can be set, for example, as follows.

The pouring openings 25*a* and 25*b* are disposed on the circumferential edges at opposite sides of the setting position of the operation lever member 23 respectively at angles of 55°, where the center 22*o* is the origin, and the base line is the X–Y line which connects the setting position of the operation lever member 23 and the center 22*o*. In addition, the five engagement-release convex (or concave) parts 27*a,* 27*b,* 27*c,* 27*c,* and 27*e,* are provided respectively on the surface of the side on which the operation lever member 23 is disposed, and first, 27*c* is disposed on this X–Y line. Next, on one side, making the X–Y line the base line, 27*b* and 27*a* are provided with an angle of separation of 35° along the same circumference having the center 22*o* as the origin, and on the other side, in the same manner 27*d* and 27*e* are provided with an angle of separation of 35° along the same circumference having center 22*o* as the origin.

In addition, the two engagement-release concave (or convex) parts 15*a,* 15*b* disposed on the bottom surface 11*a* of the pouring member 11 which engages the engagement-release convex (or concave) part 27 of the rotating lid member 21 are disposed respectively at 35° angles on both sides of the line perpendicular to the line connecting the two fixed pouring openings 12*a,* 12*b* and transiting the center 11*o* on the same circumference, whose dimension from the center is equal to the dimension from the center 22*o* of the engagement-release convex (or concave) part 27 of the rotating lid member 21, and having the center 11*o* as the origin.

Thereby, the five engagement-release convex (or concave) parts of the lid body 22 of the rotating lid member 21, which engage with the two engagement-release concave (or convex) parts 15*a,* 15*b* on the bottom surface 11*a* of the pouring member 11, engage with a pair of every other convex (or concave) part, such as 27*a*–27*c,* 27*b*–27*d,* or 27*c*–27*e*.

In addition, as the engagement-release part, when the engagement-release concave (or convex) parts 15*a,* 15*b* are disposed opposite one another on the bottom surface 11*a* of the pouring member 11, the five engagement-release convex (or concave) parts 27*a,* 27*b,* 27*c,* 27*d,* and 27*e,* of the lid body 22 of the rotating lid member 21 can be made concave, of course the opposite arrangement is possible. Moreover, in addition, in the above-mentioned embodiment, an example was shown wherein there are two engagement-release concave (or convex) parts on the pouring member 11, and five engagement-release convex (or concave) parts are provided on the lid body 22 of the rotating lid member 21 which engages with them, but contrariwise, there can be five on the bottom surface 11*a* of the pouring member 11 and two on the lid body 22 of the rotating lid member 21. Furthermore, the number of these engagement-release concave (or convex) parts is not limited to the stated numbers, but of course if the positioning of the above-described three position states is possible, any number of these parts is also possible.

In addition, any kind of member, besides a member having a concave (or convex) member, can be used for the above-described engagement-release member if the structure of the member can regulate rotation.

In the pouring member 11 and rotating lid member 21 having the above kind of structure, the lid body 22 of the rotating lid member 21 is inserted in the container shaped pouring member 11, and the rotating axle 24 is inserted into this axle support hole 14 of the pouring member 11, which is disposed at the center 22*o* of the lower sliding surface 22*a* of the lid body 22, by aligning their shapes. And after insertion, the lid body 22 is pressed in and rotated 180° on the axis of the rotating axle 24, and the axle support hole 14 of the pouring member 11 is force engaged on the back surface of the large diameter projection part 24 of the rotating axle 24, and the convex (or concave) parts 27*b* and 27*d* among the five engagement-release convex (or concave) parts 27*a,* 27*b,* 27*c,* 27*d,* and 27*e,* disposed on the lid body 22 of the rotating lid member 21, are engaged with the two engagement-release concave (or convex) parts 15*a* and 15*b* on the bottom surface 11*a* of the pouring member 11. Thereby, the two pouring openings 25*a,* 25*b* on the lid body 22 of the rotating lid member 21, disposed adjacently at an angle of 180° or less, are disposed on the bottom surface 11*a* between the two fixed pouring openings 12*a,* 12*b* (at an angle of about 180°), which are disposed on opposite sides of the center provided on the bottom surface 11*a* of the pouring member 11. Additionally, the two fixed pouring openings 12*a,* 12*b* on the bottom surface of the pouring member are positioned in a closed state by the lid body 22 of the rotating lid member 21. Moreover, they are integrated by sliding rotatably.

Thereby, in the opening member 20, wherein the rotating lid member 21 is engaged integrally in the pouring member 11 by rotatably sliding the lower sliding surface 22*a* of the lid body 22 on the bottom surface 11*a* of the pouring member 11, as shown in FIG. 1, the shell 11*b* of the pouring member 11 is inserted into the opening 6 of the heat retaining cup 1 directly or via the drinking opening 7*b* of the shoulder member 7 disposed in this opening 6, and the interfitting installation shield 13 provided along its outer perimeter in installed airtight by forced interfitting.

Moreover, during installation of this a closing member of an opening 20 in the opening 6 of the heat retaining cup 1, when the operation lever member 23, at the time the lid body 22 of the rotating lid member 21 has closed the two fixed pouring openings 12*a,* 12*b* of the bottom surface 11*a* of the pouring member 11, is installed by aligning the position of the handle 8 of the heat retaining cup 1, it is convenient for judging whether the fixed pouring openings 12*a,* 12*b* are open or closed by rotation of the rotating lid member 21 and which fixed pouring opening must be opened or closed.

Thus, in a closing member of an opening 20 disposed by installation in the opening 6 of the heat retaining cup 1, the fixed pouring openings 12*a,* 12*b* on the bottom surface 11*a* of the pouring member 11 are opened and closed by the following type of operation.

At the time of installation, the two convexo-concave parts 27*b* and 27*d* among the five engagement-release convex (or concave) parts 27*a,* 27*b,* 27*c,* 27*d,* and 27*e* provided on the lower sliding surface 22*a* of the lid body 22 of the rotating lid member 21 are engaged in the two engagement-release concave (or convex) parts 15*a,* 15*b* provided on the bottom surface 11*a* of the pouring member 11, and the pouring openings 25*a,* 25*b* of the rotating lid member 21 are positioned at a middle position between the two fixed pouring openings 12*a,* 12*b* of the bottom surface 11*a* of the pouring member 11, and the two fixed pouring openings 12*a,* 12*b* of the bottom surface 11*a* of the pouring member 11 are maintained in a closed state by the lid body 22 of the rotating lid member 21.

Next, when the rotating lid member 21 is rotated rightward (clockwise) along the inner circumferential wall of the shell 11*b* of the pouring member 11 by the operation lever 23 of the rotating lid member 21, the engagement-release convex (or concave) parts 27*b* and 27*d* of the lid body 22 engaged beforehand are detached from the engagement-release concave (or convex) parts 15*a,* 15*b* of the bottom surface 11*a* of the pouring member 11. Then when further rotated in the rightward direction, a clicking sound is made, and the engagement-release convex (or concave) parts 27*c,* 27*e* provided on the lower sliding surface 22*a* of the lid body 22 are respectively engaged in the engagement-release concave (or convex) parts 15*b,* 15*a* on the bottom surface 11*a* of the pouring member 11, and thereby the rotation of the rotating lid member 21 is regulated. In addition, one of the pouring openings 25*a* of the lid body 22 of the rotating lid member 21 is aligned with one fixed pouring opening 12*a* among the two fixed pouring openings of the bottom surface 11*a* of the pouring member 11, and liquid can pass through this fixed pouring opening 12*a*.

At the same time, the air hole 26*a* provided in a position opposite to the pouring opening 25*a* of the lid body 22 across the center overlaps the other fixed pouring opening 12*b* of the bottom surface 11*a* of the pouring member 11, and air can pass to the inside of the cup 1. As a result, the liquid, such as a drink, stored in the heat retaining cup 1 can pour from the fixed pouring opening 12*a*. In addition, in this case, because the fixed pouring opening 12*a* through which liquid can flow, as shown in the drawing in FIG. 1, is on the opposite side, on the cup at the position of the handle 8, it is difficult for a right handed person to hold the handle 8 and drink or pour, but it is convenient for a left handed person.

In the rotating operation of the above-described rotating lid member 21, the rotating lid member 21 can be rotated with little resistance on the sliding surface and extremely smoothly because the container shaped sliding ring shaped projections 17 and 28 for augmenting rotation are provided to follow respectively the rotation of the bottom surface 11*a* of the pouring member 11 and the lower sliding surface 22*a* of the lid body 22 of the rotating lid member 21 which slides thereon.

Moreover, these convex shaped sliding ring shaped projections 17, 28 for augmenting rotation can carry out much smoother rotation by the cross-section being made a semicircular arc.

From this state, when rotating the rotating lid member 21 leftward (counterclockwise) by the operation lever 23, the previously engaged engagement-release convex (or concave) parts 27*e* and 27*c* of the lid body 22 are release from the engagement-release concave (or convex) parts 15*a,* 15*b* of the bottom surface 11*a* of the pouring member 11. In addition, when rotated further to the left, a clicking sound is made, and the engagement-release convex (or concave) parts 27*d,* 27*b* provided on the lid body 22 engage respectively with the engagement-release concave (or convex) parts 15*a,* 15*b* of the bottom surface 11*a* of the pouring member 11, and the rotation of the rotating lid member 21 is regulated. At this time, the pouring openings 25*a,* 25*b* of the lid body 22 of the rotating lid member 21 are separated from the two fixed pouring openings 12*a,* 12*b* of the bottom surface 11*a* of the pouring member 11, and the lid body 22 closes the fixed pouring openings 12*a,* 12*b* of the bottom surface 11*a* of pouring member 11, returning to the previously closed state. Additionally, entry of contaminants into the heat retaining cup 1, spilling from the inside of the heat retaining cup 1, and dissipation of heat are prevented.

Next, from this state, when the rotating lid member 21 is rotated further to the left by the operation lever 23, the engagement-release convex (or concave) parts 27*d,* 27*b* of the lid body 22 of the rotating lid member 21 engaged with the engagement-release concave (or convex) parts 15*a,* 15*b* of the bottom surface 11*a* of the pouring member 11 are released, and the lid body 22 of the rotating lid member 21 is rotated by sliding along the bottom surface 11*a* of the pouring member 11. When rotated further to the left, a clicking sound is made, and the engagement-release convex (or concave) parts 27*a,* 27*c* provided on the lid body 22 are respectively engaged with engagement-release concave (or convex) parts 15*a,* 15*b* of the bottom surface 11*a* of the pouring member 11, and the rotation of the rotating lid member 21 is regulated. Additionally, the other pouring opening 25*b* of the lid body 22 of the rotating lid member 21 aligns with the other fixed pouring opening 12*b* among the two fixed pouring openings of the bottom surface 11*a* of the pouring member 11, and liquid can flow from this fixed pouring opening 12*b*.

At the same time, the air hole 26*b* provided in a position opposite to the pouring opening 25*b* of the lid body 22 across the center overlaps the other fixed pouring opening 12*a* of the bottom layer 11*a* of the pouring member 11, and air can flow in and out of the cup 1. As a result, a liquid such as a drink stored in the heat retaining cup 1 can pour out extremely smoothly from the fixed pouring opening 12*b*.

Additionally, because the fixed pouring opening 12*b,* from which, in this case, liquid can flow, as shown in the drawing in FIG. 1, is positioned in front, at the disposition position of this handle 8 on the cup, a right handed person can grasp the handle 8 to pour and drink, and this is convenient for a right handed person.

After finishing pouring, the rotating lid member 21 is rotated to the right (clockwise) by the operation lever 23, the previously engaged engagement-release convex (or concave) parts 27*a,* 27*b* of the lid body 22 are released from the engagement-release from concave (or convex) parts 15*b,* 15*a* of the bottom surface 11*a* of the pouring member 11, and the engagement-release parts 27*d,* 27*b* provided on the lid body 22 respectively engage the engagement-release concave (or convex) parts 15*a,* 15*b* of the bottom surface 11*a* of the pouring member 11. Additionally, the lid body 22 closes airtight the fixed pouring openings 12*a,* 12*b* of the bottom surface 11*a* of the pouring member 11, returning to the original closed state, and entry of contaminants into the heat retaining cup 1, spilling from the inside of the heat retaining cup 1, are dissipation of heat are prevented.

Moreover, in the above-described embodiment, the bottom surface 11*a* of the pouring member 11 and the lid body 22 of the rotating lid member 21 which rotates by sliding thereon have an umbrella shape which rises gradually towards their respective centers, center 11*o* and center 22*o,* thereby providing a strength for resisting deformation from the load accompanying their mutual forced engagement, and at the same time allows these parts to be thin.

In addition, by being made in this umbrella shape, after pouring liquid or drinking, etc., the liquid returns to the pouring opening by flowing down along the umbrella shaped surface, making it more sanitary because it is difficult for a liquid to remain on the surface of the lid body.

Moreover, in the above-described embodiment, as a container for liquids, the explanation was given using a heat retaining cup as an example, but the structure of the opening of the present invention is not limited to this, and can of course be applied to the opening of any kind of container for liquids, if it is a container for liquids used for storing and pouring a liquid, such as a measuring cup, a water bottle, a thermos bottle, or a mug.

What is claimed is:

1. The combination of a container and a bi-directional closure to dispense liquid through the container open mouth comprising:

a container shaped pouring member fitting into the container open mouth to seal the mouth, said pouring member having a pair of spaced outlet ports comprising cutouts in the outer edge of the pouring member spaced apart by 180°;

a lid fitting within said container shaped pouring member and being rotatably mounted relative to said pouring member, said lid having a pair of spaced liquid pouring openings, a pair of spaced air holes, and an operation lever protruding outwards from the pouring member, said pair of spaced pouring openings and said pair of spaced air holes comprising cutouts in the lid outer edge with said pouring openings spaced apart at an angle less than 180° around said lid;

a handle mounted on the container body and projecting therefrom;

said container shaped pouring member fitting into the container open mouth to seal the mouth when said pair of spaced outlet ports are positioned respectively on the right and the left with respect to said handle mounted on the container body; and said lid in a home position relative to said pouring member with said lid operation lever substantially aligned with said handle sealing said pair of outlet ports of said pouring member, rotation of said lid relative to said pouring member in a first direction from said home position by a predetermined amount to a first position by operating said operation lever aligning a respective one of said lid pouring openings with a pouring member outlet port and one of said lid air holes with the other of said pouring member outlet ports, and rotation of said lid relative to said pouring member in a second direction opposite to said first direction by a predetermined amount to a second position by operating said operation lever aligning the other of said lid pouring openings with the other outlet port of said pouring member and the other of said lid air holes with said pouring member one outlet port.

2. A closure as in claim 1 further comprising cooperating locking members on said lid and pouring member to lock said lid in each of said first and second positions.

3. A closure as in claim 2 wherein said locking members comprise one convex member and one concave member on each of said lid and said pouring member.

4. A closure as in claim 3 wherein one of said concave and convex locking members is elastic.

5. A closure as in claim 1 wherein a surface of said pouring member and a surface of said lid slide relative to each other and have convex shapes which gradually rises toward the center of each of said pouring member and said lid.

6. A closure as in claim 1 further comprising an opening on one of said pouring members and said lid and an axle on the other of said pouring member and said lid to permit rotation of one relative to the other.

* * * * *

UNITED STATES PATENT AND TRADEMARK OFFICE

CERTIFICATE OF CORRECTION

PATENT NO. : 6,216,903 B1
DATED : April 17, 2001
INVENTOR(S) : Masato Hirose et al.

It is certified that error appears in the above-identified patent and that said Letters Patent is hereby corrected as shown below:

Title page,
Item [30] Foreign Application Priority Data, change
"March 19, 1998" to -- March 27, 1998 --.

Signed and Sealed this

Twenty-sixth Day of March, 2002

*Attest:*

*Attesting Officer*

JAMES E. ROGAN
*Director of the United States Patent and Trademark Office*